US007863836B2

(12) United States Patent
Mednik et al.

(10) Patent No.: US 7,863,836 B2
(45) Date of Patent: Jan. 4, 2011

(54) CONTROL CIRCUIT AND METHOD FOR REGULATING AVERAGE INDUCTOR CURRENT IN A SWITCHING CONVERTER

(75) Inventors: Alexander Mednik, Campbell, CA (US); Rohit Tirumala, Sunnyvale, CA (US); Marc Tan, Sunnyvale, CA (US)

(73) Assignee: Supertex, Inc., Sunnyvale, CA (US)

( * ) Notice: Subject to any disclaimer, the term of this patent is extended or adjusted under 35 U.S.C. 154(b) by 289 days.

(21) Appl. No.: 12/135,302

(22) Filed: Jun. 9, 2008

(65) Prior Publication Data

US 2009/0302774 A1 Dec. 10, 2009

(51) Int. Cl.
*H05B 37/02* (2006.01)

(52) U.S. Cl. ..... 315/360; 315/224; 315/294

(58) Field of Classification Search ..... 315/209 R, 315/224, 225, 247, 291, 294, 297, 307, 360; 363/21.13, 21.16, 21.17; 323/222, 274, 277, 323/282, 284, 285

See application file for complete search history.

(56) References Cited

U.S. PATENT DOCUMENTS 4,594,531 A * 6/1986 Ganser et al. ..... 315/307
2004/0232897 A1* 11/2004 Yoshida et al. ..... 323/282
2005/0035724 A1* 2/2005 Lurkens ..... 315/291
2006/0113975 A1* 6/2006 Mednik et al. ..... 323/282
2007/0247121 A1* 10/2007 Wu et al. ..... 323/222
2008/0129220 A1* 6/2008 Shteynberg et al. ..... 315/291
2008/0180973 A1* 7/2008 Park et al. ..... 363/21.01

* cited by examiner

*Primary Examiner*—Douglas W Owens
*Assistant Examiner*—Tung X Le
(74) *Attorney, Agent, or Firm*—Jeffrey D. Moy; Weiss & Moy, P.C.

(57) ABSTRACT

A switching power converter has an input voltage source. An output load is coupled to the input voltage source. An inductive element is coupled to the load. A switch is coupled to the inductive element. A current reference input is provided. A control circuit is coupled to the switch and the current reference input for activating and deactivating the switch. The inductive element receives power from the input voltage source when the switch is activated and conducting continuous current. The control circuit deactivates the switch after a controlled delay time when the current in the inductive element and the switch exceeds the current reference input so that an average current in the inductive element is determined by a magnitude of the current reference input.

18 Claims, 6 Drawing Sheets

CONTROL CIRCUIT AND METHOD FOR REGULATING AVERAGE INDUCTOR CURRENT IN A SWITCHING CONVERTER

BACKGROUND

The present invention relates generally to power supplies, and, more specifically, to current-programmed controlled switching power converter and method which allows for controlling average inductor current by monitoring a partial current in an output filter inductor.

Current-programmed control, a scheme in which the output of a switch-mode power supply (SMPS) is controlled by choice of the peak current in a switching transistor, finds wide applications due to its ease of implementation, fast transient response and inherent stability. The current in the switching transistor is representative of the output current scaled by the duty ratio of the switching transistor. However, due to the switching ripple current in inductive elements, controlling the peak current produces an error with respect to the average output current. This error affects the accuracy of the current control loop and diminishes the benefits of the control method. Moreover, the full inductor current required for average current control is not always readily accessible for sensing.

Therefore, it would be desirable to provide a system and method that overcomes the above problems.

SUMMARY

An embodiment of a switching power converter has an input voltage source. An output load is coupled to the input voltage source. An inductive element is coupled to the load. A switch is coupled to the inductive element. A current reference input is provided. A control circuit is coupled to the switch and the current reference input for activating and deactivating the switch. The inductive element receives power from the input voltage source when the switch is activated and conducting continuous current. The control circuit deactivates the switch after a controlled delay time when the current in the inductive element and the switch exceeds the current reference input so that an average current in the inductive element is determined by a magnitude of the current reference input A method of regulating average current in an inductive element of a switching power converter, the converter comprising an inductive element and a controlled switch, the method comprising: periodically switching the controlled switch on; detecting a moment when a current in the inductive element exceeds a reference level; and switching the control switch off after a controlled delay following the moment.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

The present invention provides novel circuits and methods for controlling output current or voltage of a switching power supply. As a result, accuracy and stability of a switching power converter can be improved and reduction in the component count can be achieved by incorporating one or more aspects of the present invention. The present invention includes, alone or in combination, a unique average-current control circuit whose output is independent power component variation and adaptive to varying output load and input supply.

Figure 1:
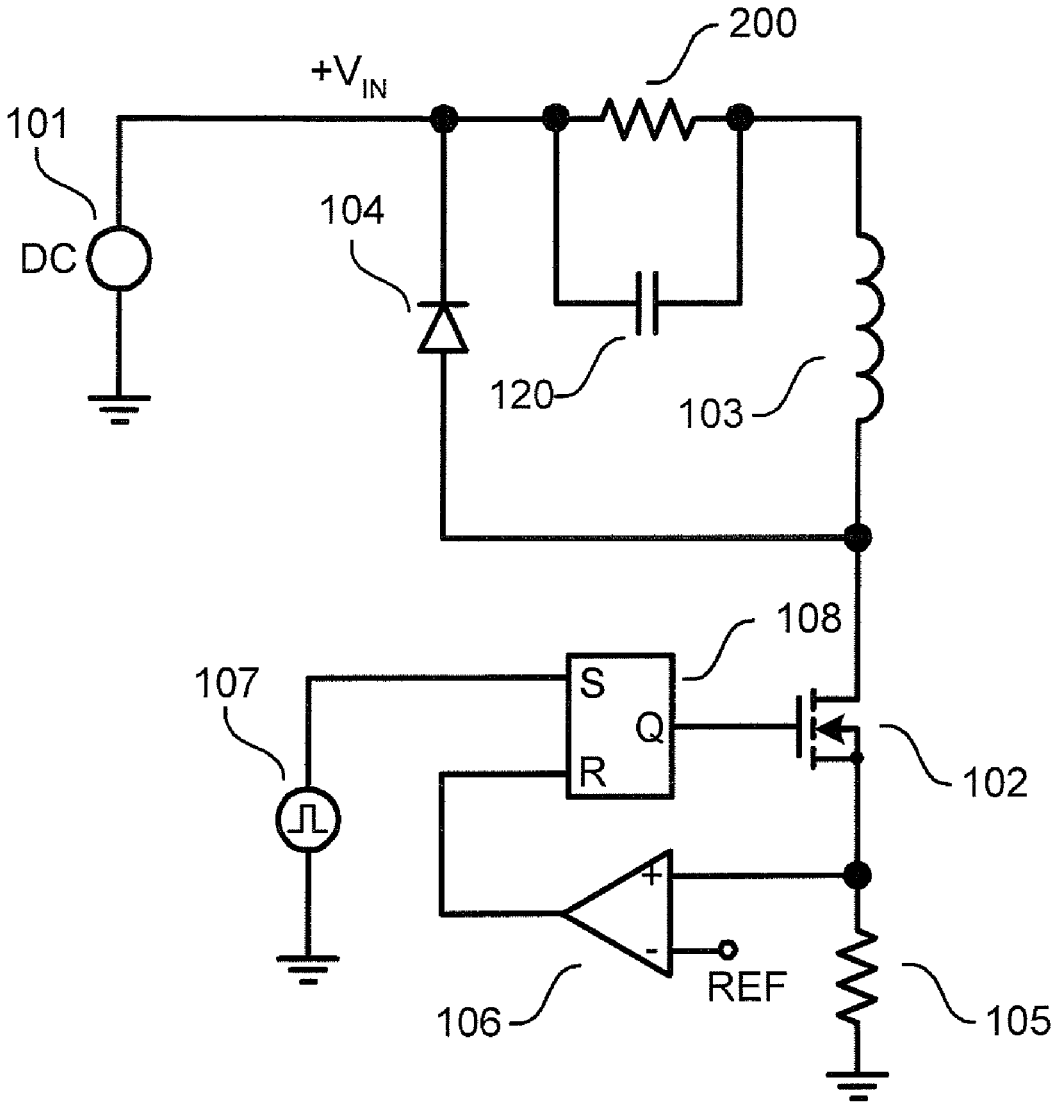
Prior Art Figure 1
FIG. 1 depicts a prior-art current-programmed controlled buck converter.

Referring to FIG. 1, a prior-art CPC buck converter is shown. The converter receives power from an input DC voltage source 101, delivers regulated DC current to the output load 200, and includes a controlled switch 102, an inductor 103, an output filter capacitor 120, a catch diode 104, a current sense resistor 105, a current sense comparator 106 with a reference REF, and a PWM latch 108 receiving a clock signal from an oscillator 107.

Figure 2:
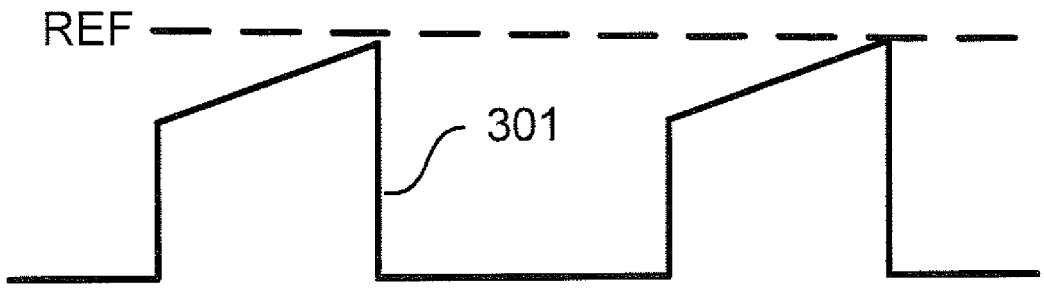
Prior Art Figure 2
FIG. 2 illustrates the switch current wave shape in a current-programmed controlled switching converter.

In operation, the PWM latch 108 receives the clock signal 107, and the switch 102 conducts the current from the inductor 103. The current sense resistor 105 monitors the current in the switch 102. The wave shape 301 shown in FIG. 2 represents this current sense signal. The comparator 106 resets the latch 102 when the voltage at the sense resistor 105 exceeds the reference level REF, and the switch 102 turns off. The cycle repeats upon receiving the next clock pulse from the oscillator 107.

Figure 3:
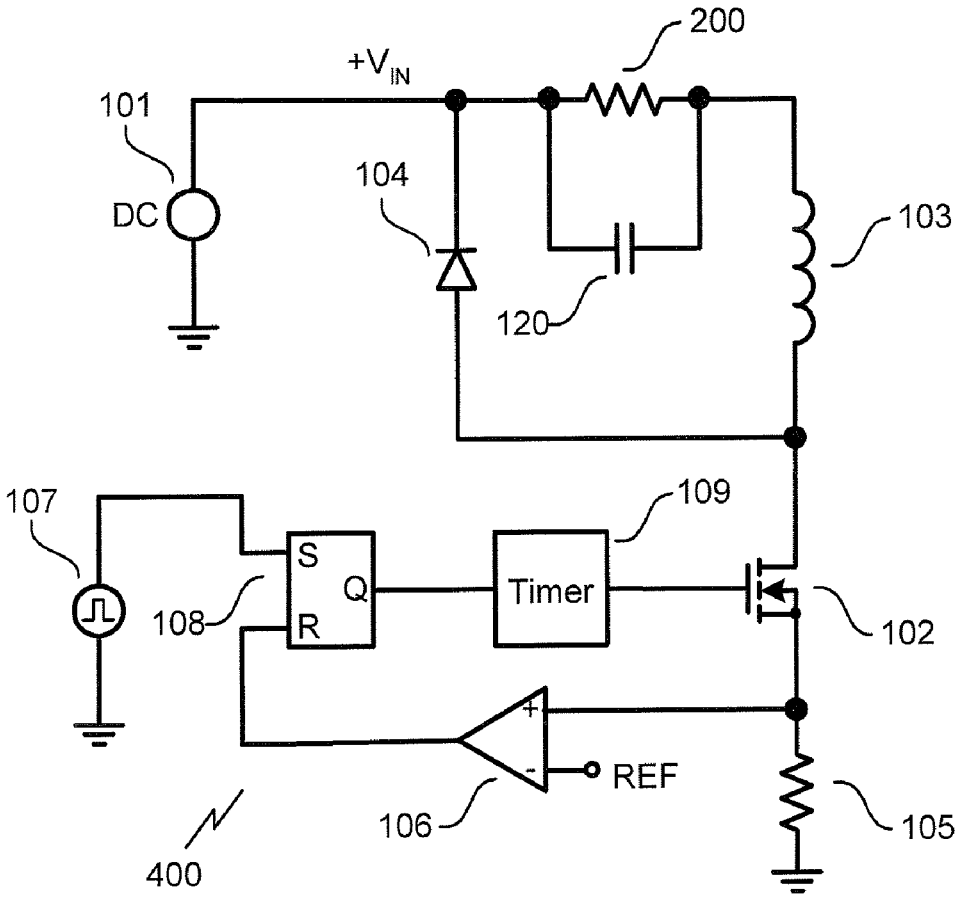
FIG. 3 shows a current-programmed controlled buck converter of the present invention.

Referring to FIG. 3, a block diagram of one embodiment of the present invention is shown. The depicted circuit is a buck converter receiving power from an input DC voltage source 101 and delivering regulated DC current to the output load 200. The circuit includes an inductor 103 having a first terminal attached to the load 200. A second terminal of the inductor 103 is attached to a first terminal of the controlled switch 102. A third terminal of the controlled switch 102 is attached to a current sensor resistor 105. An output filter capacitor 120 may be attached to the load 200. As shown in FIG. 1, the output filter capacitor 120 will have a first terminal and a second terminal attached to the first terminal and the second terminal respectively of the load 200. A catch diode 104 has a first terminal attached to the second terminal of the inductor 103 and a second terminal attached to the first terminals of the load 200 and the filter capacitor 120.

A control circuit 400 is attached to a second and the third terminals of the controlled switch 102. The control circuit 400 has a PWM latch 108. A set input of the PWM latch 108 is attached to an oscillator 107. A reset input of the PWM latch 108 is attached to an output of a current sense comparator 106. The current sense comparator 106 has one input coupled to the third terminal of the controlled switch 102 and a second input attached to a reference voltage REF. The output of the PWM latch 108 is attached to a timer 109. The output of the timer 109 is attached to the second terminal of the controlled switch 102.

Figure 4:
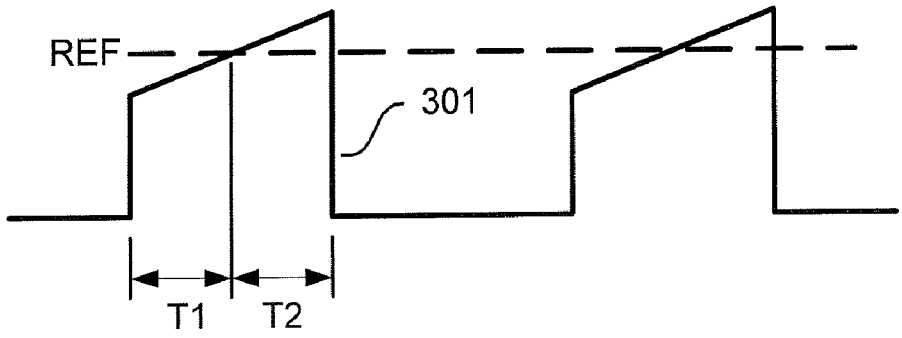
FIG. 4 shows the switch current wave shape in a current-programmed controlled switching converter of the present invention.

Referring to FIGS. 3 and 4, wherein FIG. 4 shows the voltage wave shape across the resistor 105, the operation of the converter of FIG. 3 will be discussed. When the voltage at the sense resistor 105 exceeds the reference level REF, the comparator 106 sends a signal to reset the latch 102. The output of the latch 109 starts the timer 109. The timer 109 delays the switch 102 turn-off by a time T2. In steady-state operation, the time T2 is substantially equal to the time T1 it took the current sense voltage to reach the reference level REF from the beginning of the conduction cycle of the switch 102. Under the assumption of a linear rise of the inductor current, the reference level REF corresponds to the average current in the inductor 103. Hence the circuit maintains constant current in the load 200 independent of the current ripple amplitude in the inductor 103.

Figure 5:
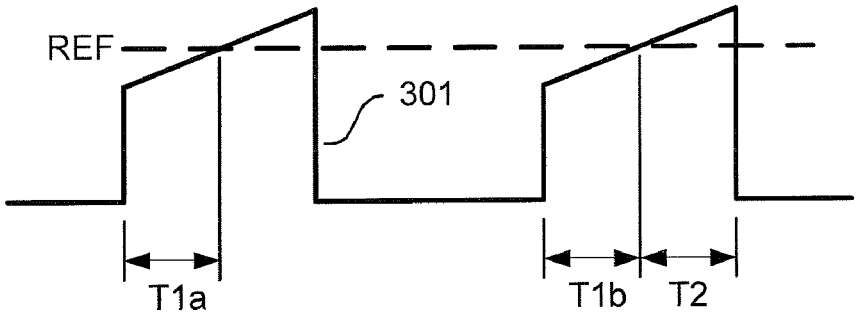
FIG. 5 shows the wave shape of FIG. 4 explaining the operating principle of the converter of FIG. 3.

Referring to the wave shape 301 across the resistor 105 shown in FIG. 5, the timer 109 calculates the delay T2 as an average of T1*a* and T1*b* in two preceding sequential conduction cycles of the switch 102, such that T2=(T1*a*+T1*b*)/2. The timer 109 operated in this way attenuates oscillation of the output current at the second subharmonic of the switching frequency, otherwise occurring in the converter of FIG. 3. The oscillator circuit 107 can be operated in the fixed-frequency mode or at constant off-time of the switch 102.

Figure 6:
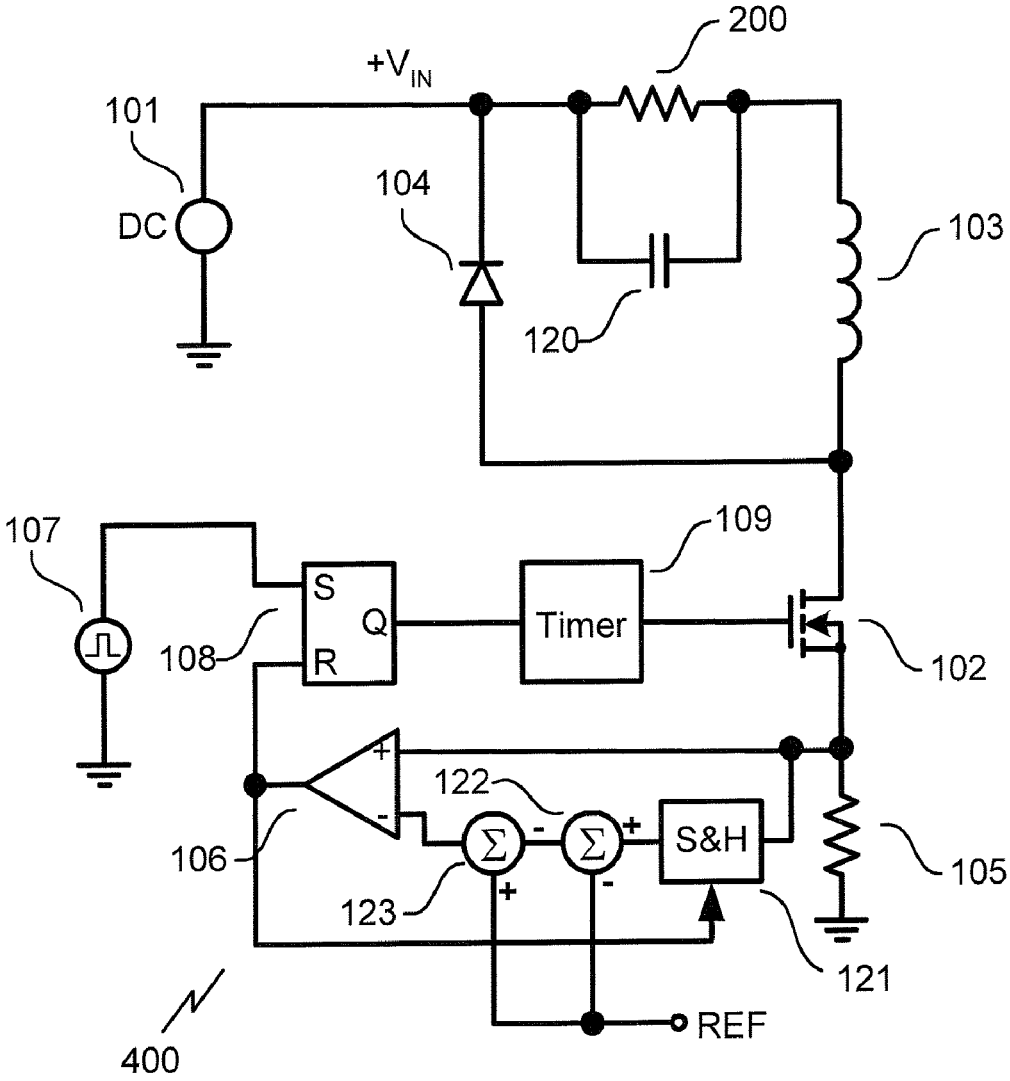
FIG. 6 depicts a transformer-coupled switching converter employing the current-programmed control of the present invention.

Referring now to FIG. 6, another embodiment of the converter of FIG. 3 is shown. In this embodiment, the converter eliminates the error in the average inductor current due to the propagation delay and the input offset voltage of the comparator 106. In the present embodiment, the control circuit 400 additionally comprises a sample-and-hold circuit 121 and two subtraction blocks 122 and 123. The sample-and-hold circuit 121 has a first terminal attached to the current sense resistor 105 and to the first terminal of the comparator 106, a second terminal attached to the output of the comparator 106 and an output attached to the subtraction block 122. The output of the subtraction block 122 is attached to an input of the subtraction block 123. Both subtraction blocks 122 and 123 are attached to the reference voltage REF. The output of the subtraction blocks 123 is attached to the comparator 106.

In operation, the sample-and-hold circuit 121 samples the current sense level at the moment of the output transition of the comparator 106. This level is further compared with the reference input REF by the subtraction block 122, and the difference is further subtracted from the reference input REF by the subtraction block 123. The resulting corrected reference level is applied at the reference input of the comparator 106

Figure 7:
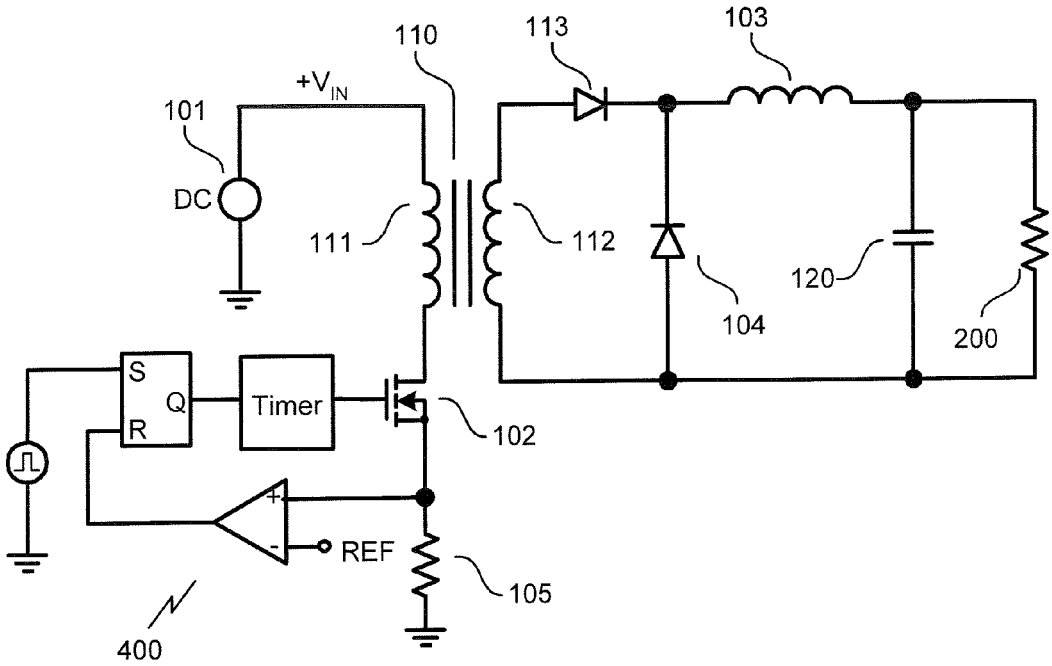
FIG. 7 depicts the converter of FIG. 3 powering a string of light emitting diodes with regulated DC current.

The control circuit 400 can be used to operate any power supply circuit including at least one inductor 103 operating in the continuous conduction mode. Referring to FIG. 7, another embodiment of the present invention is shown, wherein the power converter is of a transformer-coupled forward type. The converter receives power from an input DC voltage source 101, delivers regulated DC current to the output load 200.

The converter has a power transformer 110 having a primary winding 111 and a secondary winding 112. The DC voltage source 101 is coupled to the primary winding 111. The control circuit 400 is also coupled to the primary winding 111. A control diode 113 is coupled to the secondary winding 112. The inductor 103 has a first terminal attached to the load 200. A second terminal of the inductor 103 is attached to the control diode 113. The output filter capacitor 120 may be attached to the load 200. The output filter capacitor 120 will have a first terminal and a second terminal attached to the first terminal and the second terminal respectively of the load 200. A catch diode 104 has a first terminal attached to the second terminal of the inductor 103 and a second terminal attached to the load 200, the filter capacitor 120, and the secondary winding 112.

In operation, when the switch 102 conducts, the current in the primary winding 111 is reflecting the current in the inductor 103 conducted through the control diode 113 and the secondary winding 112. Hence, the operation of the circuit of FIG. 7 is largely identical to the one of the converter of FIG. 3, with the only exception of the sense resistor 105 conducting a replica of the current in the inductor 103 scaled by the turn ratio between the windings 111 and 112.

Figure 8:
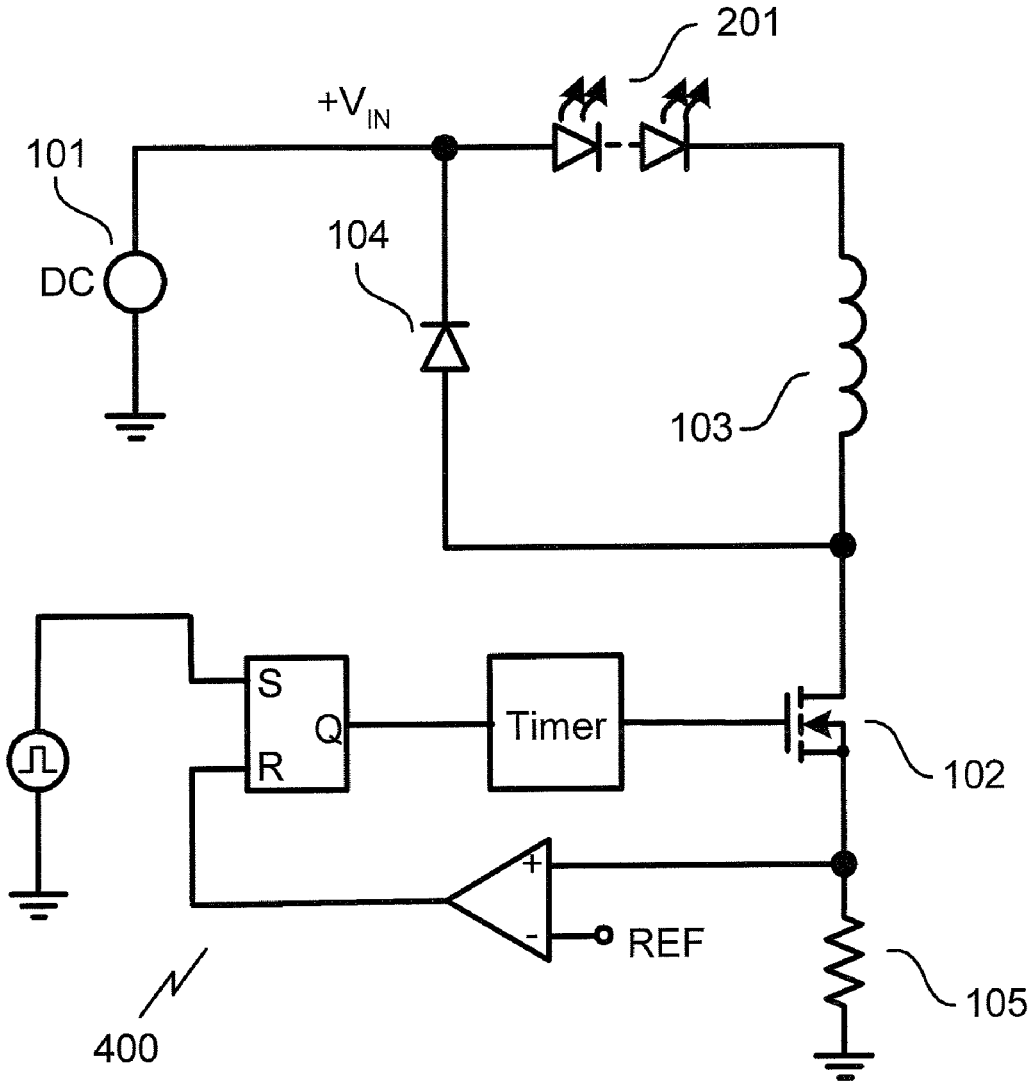
FIG. 8 shows another embodiment of a current-programmed controlled buck converter of the present invention.

Referring to FIG. 8, another embodiment of the present invention is shown, wherein the load 200 of FIG. 3 is replaced by a light-emitting diode (LED) or a series-connected string of LEDs 201. The output capacitor 120 of FIG. 3 is optional, since the current in the inductor 103 is largely DC. With the above exceptions, the LED driver circuit of FIG. 8 is identical to the converter of FIG. 3. Provided a constant reference level REF and continuous conduction of the inductor 103, the LED driver maintains regulated average output current regardless of the inductance value of the inductor 103, input voltage at the voltage source 101, voltage at the LED load 201, switching frequency of the control circuit 400.

The circuits and methods of the present invention eliminate the peak-to-average current sense error in a current-programmed control (CPC) circuit of a switching converter.

The switching converter receives energy from an input voltage source and delivers this energy to the output load 200 by storing it fully or partially in one or more inductive elements 103. The energy is directed by periodical switching of two or more switching devices, at least one of which devices being controlled switches 102. In CPC, the conduction time of the controlled switch 102 is determined by the time required for the current in the inductive element 103 to reach a programmed level.

CPC control methods are provided for controlling the average current in the inductive element 103, rather than its peak current, at a programmed value. The methods include measuring conduction time of the controlled switching device 102 elapsed, before the current in the inductive element 103 reaches a programmed level; and delaying the turn off of the switching device 102 by the measured time. The methods also include averaging the elapsed conduction time over at least two consequent switching cycles of the controlled switching device 102.

While embodiments of the disclosure have been described in terms of various specific embodiments, those skilled in the art will recognize that the embodiments of the disclosure can be practiced with modifications within the spirit and scope of the claims.

What is claimed is:

1. A switching power converter comprising:

an input voltage source;

an output load coupled to the input voltage source;

an inductive element coupled to the load;

a switch coupled to the inductive element;

a current reference input;

a control circuit coupled to the switch and the current reference input for activating and deactivating the switch, the inductive element receiving power from the input voltage source when the switch is activated and conducting continuous current, the control circuit deactivating the switch after a controlled delay time when the current in the inductive element and the switch exceeds the current reference input so that an average current in the inductive element is determined by a magnitude of the current reference input, wherein said control delay is substantially equal to one half of conduction time of the switch.

2. A switching power converter in accordance with claim 1, further comprising a timer circuit coupled to the control circuit for timing an interval between the switch being switched on and the current in the inductive element reaching the magnitude of the reference input, the timer circuit generating the controlled delay substantially equal to the interval.

3. A switching power converter in accordance with claim 2, wherein the timer circuit generates the control delay being equal to an average duration of the interval over at least two consecutive conduction times of the switch.

4. A switching power converter in accordance with claim 1, further comprising:

a current sense element coupled to the switch for detecting the current in the switch; and a comparator coupled to the current sense element and the current reference input for comparing the output of the current sense element with the current reference input and for sending a signal for commencing the controlled delay.

5. A switching converter in accordance with claim 1, wherein the switch is activated repeatedly at a constant frequency rate.

6. A switching converter in accordance with claim 1, wherein the switch is activated repeatedly, and wherein a conduction pause duration of the switch is constant.

7. A switching converter in accordance with claim 4, further comprising:

a sample-and-hold circuit coupled to the control circuit for repetitive holding a level of the output signal at the current sense element following the output state change of the comparator; and a subtraction block circuit coupled to the sample and hold circuit for deriving a difference between a level of the output signal and a reference input magnitude;

wherein said comparator circuit commences the control delay when the output signal of the current sense element exceeds the reference input level reduced by the magnitude of the difference.

8. A switching converter in accordance with claim 1 wherein the converter is a buck type, the reference input magnitude being fixed.

9. A switching converter in accordance with claim 1, wherein the output load is at least one light emitting diode.

10. A switching converter in accordance with claim 1, further comprising a switching power transformer having at least one primary winding and at least one secondary winding, wherein current of the inductive element is coupled to the switch by the power transformer.

11. A switching converter in accordance with claim 1, wherein magnitude of the current reference input is controlled as a function of voltage at the output load.

12. A switching converter in accordance with claim 1, wherein magnitude of the current reference input is controlled as a function of current at the output load.

13. A method of regulating average current in an inductive element of a switching power converter, the converter comprising an inductive element and a controlled switch, the method comprising:

periodically switching the controlled switch on;

detecting a moment when a current in the inductive element exceeds a reference level; and switching the control switch off after a controlled delay following the moment, wherein said control delay is substantially equal to one half of conduction time of the switch.

14. The method of claim 13 further comprising:

measuring a time interval between switching the control switch on and detecting the moment when the current in the inductive element exceeds the reference level;

averaging a time interval over at least two consecutive conduction cycles of the controlled switch; and delaying switching the controlled switch off with respect to the moment when the current in the inductive element exceeds the reference level by the average time interval.

15. A switching power converter comprising:

an input voltage source;

an output load coupled to the input voltage source;

an inductive element coupled to the load;

a switch coupled to the inductive element;

a current sense resistor coupled to the switch to monitor a current in the switch;

a current reference input; and a control circuit coupled to the switch and the current reference input for activating and deactivating the switch, the control circuit deactivating the switch after a controlled delay time when the current in the inductive element and the switch exceeds the current reference input, wherein said control delay is approximately equal to one half of conduction time of the switch.

16. A switching power converter in accordance with claim 15, wherein the control circuit comprises:

an oscillator;

a comparator coupled to the current sense element and the current reference input for comparing the output of the current sense element with the current reference input and for sending a signal for commencing the controlled delay;

a latch having a set input of coupled to the oscillator, a reset input coupled to an output of the comparator; and a timer circuit coupled to an output of the latch.

17. A switching power converter in accordance with claim 15, wherein the control circuit further comprises:

a subtraction block circuit coupled to the comparator and to the current reference input; and a sample-and-hold circuit coupled to the output of the comparator and to the error detector circuit for repetitive holding a level of the output signal at the current sense element following the output state change of the comparator.

18. A switching converter in accordance with claim 15, further comprising a switching power transformer having at least one primary winding and at least one secondary winding, wherein current of the inductive element is coupled to the switch by the power transformer.

* * * * *